United States Patent [19]

Berruti et al.

[11] Patent Number: 4,573,814

[45] Date of Patent: Mar. 4, 1986

[54] DOT MATRIX PRINTER

[75] Inventors: Pierangelo Berruti, Chivasso; Giancarlo Cella, Ivrea, both of Italy

[73] Assignee: Ing. C. Olivetti & C. S.p.A., Ivrea, Italy

[21] Appl. No.: 668,158

[22] Filed: Nov. 5, 1984

[30] Foreign Application Priority Data

Nov. 18, 1983 [IT] Italy ..... 68208 A/83

[51] Int. Cl.[4] ..... B41J 19/92; B41J 19/80

[52] U.S. Cl. ..... 400/568; 400/570; 400/574

[58] Field of Search ..... 400/185, 320, 320.1, 400/322, 328, 568, 570, 574, 574.1

[56] References Cited

U.S. PATENT DOCUMENTS

| | | | |
|---|---|---|---|
| 3,589,494 | 6/1971 | Gloess | 400/144.3 |
| 3,602,355 | 8/1971 | Hesse | 400/570 |
| 3,826,915 | 7/1974 | Giolitti et al. | 400/570 X |
| 4,218,151 | 8/1980 | Kondur | 400/320 X |
| 4,500,217 | 2/1985 | Swindler | 400/322 X |

*Primary Examiner*—Paul T. Sewell

*Attorney, Agent, or Firm*—Banner, Birch, McKie & Beckett

[57] ABSTRACT

The dot printer, which is of small dimensions, is used with desk top computers or as a peripheral unit with small processors. The printer writes in the serial-parallel mode by means of a thermal head (26) on a paper tape (16) wound on a writing platen (10) which advances intermittently to effect line spacing. This advancing is effected by means of a pawl (56) on a beam (50) controlled by a face cam (46) and a radial cam (48) on a cam cylinder (44) driven by a motor (45). A third cam (42) reciprocates the head (26) and, at the reversals of the head, the face cam (46) allows a spring (45) to engage the pawl (56) with a toothed wheel (62) on the platen (10) and the radial cam (48) then moves the pawl to advance the platen. The head comprises a small plate (29) of insulating material with twenty point-like resistive writing elements, and is fixed to a support (24) which is moved parallel to the cylinder by means of the third (42). A printed circuit card (71) fixed to the structure of the printer carries concentric tracks which are traversed by a sliding contact mounted on the cam cylinder (44) to produce synchronizing signals for the printing pulses.

4 Claims, 5 Drawing Figures

DOT MATRIX PRINTER

BACKGROUND OF THE INVENTION

The present invention relates to a dot matrix printer comprising a printing head movable parallel to a writing platen for selectively printing dots on a writing medium disposed on the platen and a line-spacing device comprising a toothed wheel coupled to the platen and a pawl for intermittently rotating the wheel to advance the writing medium between two successive lines of printed dots.

Various printers of the type mentioned are known; in one of these the printing head is moved by a cam rotating about an axis perpendicular to the writing cylinder. Line spacing is obtained by means of a screw with a varying pitch which is solid with the cam and engaged with a toothed wheel coupled to the cylinder by a transmission gear. Such a printer proves to be very cumbersome for use with small computers and, because of the numerous moving parts, it is very noisy. Furthermore the line-spacing device includes a friction clutch for disengaging the line-spacing device to allow the paper tape to be advanced manually.

The object of the present invention is to provide a dot matrix printer which is very compact, and silent, and has few moving parts and is such as to allow the paper to be advanced manually without the use of additional devices.

SUMMARY OF THE INVENTION

The dot matrix printer according to the invention meets this object and includes a line-spacing device comprising a frontally toothed gear wheel mounted on the platen shaft and coupled with the platen and an arm pivotally mounted on the platen shaft and arranged for radial and axial displacements relative to the toothed wheel. The arm is provided by two cam followers successively actuated by corresponding radial and axial cam profiles of a single rotatable cam member.

The invention will be described in more detail, by way of example, with reference to the accompanying drawings

DESCRIPTION OF THE PREFERRED EMBODIMENT

Figure 1:
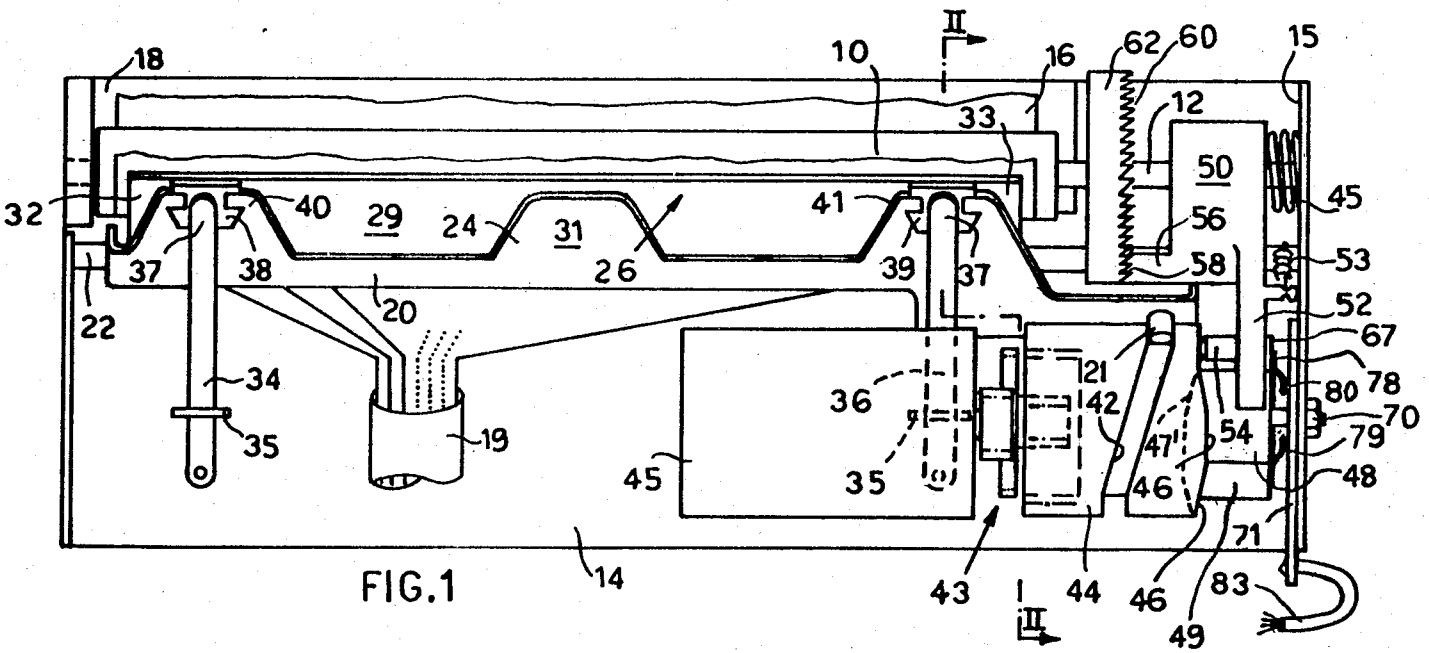
FIG. 1 is a plan view of a printer embodying the invention.

With reference to FIG. 1, the printer includes a writing platen roller 10 fitted on a shaft 12 rotatable on a base 14. A paper tape 16 is partly wound on the platen 10 and is advanced during writing operations by means of incremental rotations of the platen 10 onto which it is guided by a guide plate 18. In front of the platen 10 a slide 20 moves parallel to the axis of the platen 10 on a guide 22.

The slide comprises a flat support plate 24 on which a series-parallel thermal head 26 is fixed.

According to a particular version of the printer, the printing head 26 is similar to that described in our Italian Patent No. 1,000,641 and is formed by a small plate

29 of ceramic material, on which twenty resistive writing elements are laid aligned along a printing line parallel to the axis of the platen 10, for printing successions of dots on a thermosensitive layer of the paper 16. The small plate 29 is glued at its central region 31 to the plate 24, while at the ends 32, 33 it is simply supported. The small plate is slightly flexible and is kept pressed tangentially against the platen 10 by two elastic laminae 34, 36 fixed to the base 14 by tabs 35 and in sliding contact at one end 37 with two pads 38, 39 retained by forks 40 and 41 of the plate 24 and bearing against the small plate 29.

The slide 20 is moved by means of a peg 21 engaged with a groove 42 in the outer surface of a cylinder 44 having its axis parallel to the writing platen 10, and being rotated by a motor 45 through a reduction gear 43. The groove 42 is formed by two helical arcs having constant slope but opposite directions, each extending for about 180° and being connected together with the points of reversal of the motion of the slide 20 corresponding. Consequently during a complete rotation of the cylinder 44, the slide 24 completes one forward pass and one return pass at constant velocity. The thermal head 26 has a stroke which covers two characters which is equal to about 4 mm.

Figure 5:
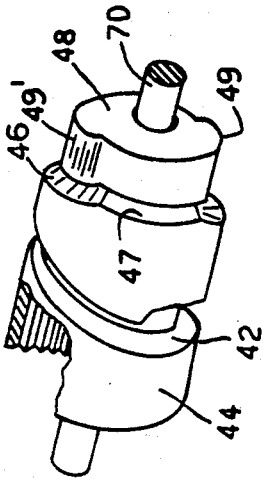
FIG. 5 shows a cam cylinder.
Figure 2:
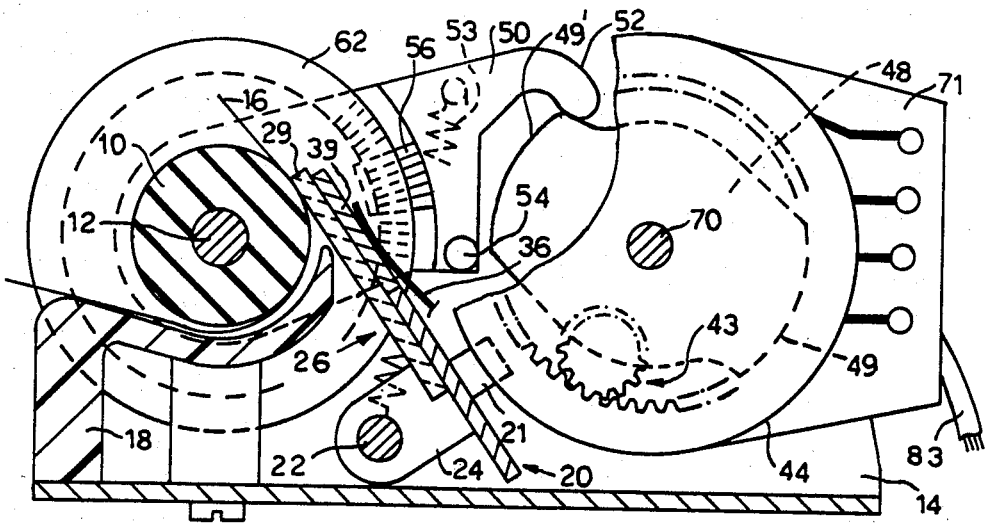
FIG. 2 is a vertical section on a larger scale on the line II—II of FIG. 1.

The cylinder 44 (FIG. 5) includes moreover a face cam 46 and a radial cam 48, which serve to produce the incremental rotation of the cylinder 10 to effect the basic line spacing between two successive lines of printed dots. The face cam 46 and the radial cam 48 include a pair of lobes 47, 47' and 49, 49' respectively which are diametrically opposed and are interposed between zero lift regions. A beam 50 (FIGS. 1 and 2) having a cam follower arm 52 held against the radial cam 48 by a spring 53 can rotate and slide axially on the shaft 12 of the writing platen. The beam 50 is provided with a peg 54 projecting in the direction parallel to the axis of rotation of the cylinder 44 and cooperating with the face cam 46 by virtue of the action of a helical spring 45 compressed between the beam 50 and a slide 15 of the base.

The beam 50 is moreover provided with an appendage 56 projecting parallel to the shaft 12 and having a sector 58 which is toothed at the front and selectively engaged with corresponding face toothing 60 of a wheel 62 fitted on the shaft 12.

The cams 46, 48 are so phased relative to the groove 42 that during the constant velocity portions of the strokes of the slide 20, the face cam 46 keeps the beam 50 spaced from the wheel 62 by overcoming the action of the spring 45. During the phases of reversal of the motion of the slide 20, the cam 46 releases the peg 54 of the beam 50 thereby allowing engagement between the toothed portion 58 of the beam 50 and the toothed wheel 62. At the same time a lobe 49 of the cam 48 (FIG. 2) rotates the beam 50 anticlockwise, and the beam in turn makes the writing platen 10 rotate through an arc corresponding to one basic line spacing of the paper 16.

Figure 3:
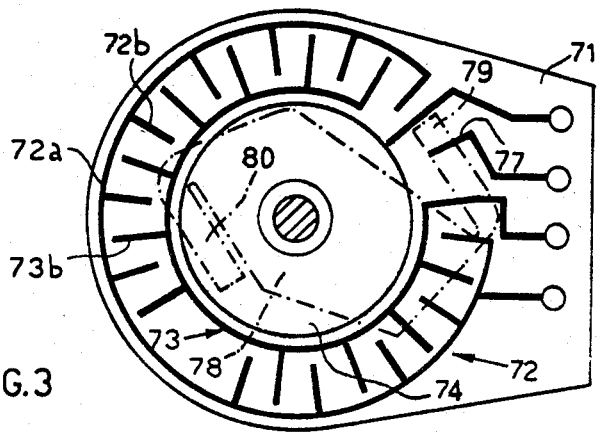
FIG. 3 shows a synchronisation card.

The timing signals necessary for synchronising with the movement of the slide 20 the printing pulses coming through a cable 19 (FIG. 1) from a logic circuit not shown in the drawings are produced by a synchronisation device comprising a small plate 71 of insulating material (FIGS. 2, 3) fixed to the side of the base 14 coaxially with the axis of rotation of the cylinder 64 and on which concentric conducting tracks 72, 73, 74 are deposited by a printed circuit technique. The track 72 is formed by an open ring 72*a* from which a plurality of inwardly directed radial segments 72*b* branch off, while the track 73 is formed by an open ring 73*a* within the track 72, from which a plurality of outwardly directed radial segments 73*b* branch off. The segments 72*b* and the segments 73*b* are regularly interdigitated.

The track 74 is formed by a ring which occupies the central part of the small plate 71 and constitutes the common return for the synchronisation circuit. On the base 67 of the cylinder 44 facing the small plate 71 a metal lamina 78 is fixed which ends in two diametrically opposed resilient contacts 79, 80, of which the contact 79 slides alternately on the segments 72*b*, 73*b*, and the contact 80 slides on the ring 74. Consequently during the rotation of the cylinder 44 the contacts 79, 80 short circuit the segments 72*b*, 73*b* and the ring 74 in order to generate the timing signals transmitted over a cable 83 to the control logic.

In the interrupted region of the rings 72, 73 an additional radial segment 77 is disposed which is used to give a line start signal when the slide 20 is at one of the ends of the stroke.

The segments 72*b*, 73*b* are equidistantly spaced by an arc corresponding to a step between two successive printed dots on the medium 16. In accordance with a first version of the printer the aforesaid arc is 11°15′ and corresponds to a step of 0.26 mm between two dots. According to the printing requirements, the step between two printed dots can be varied in a very simple manner without modifying the mechanical structure of the printer and without altering the logic architecture of the circuit controlling the printing head. To obtain a varied spacing between the printed dots the small plate 71 is interchangeable with others having a different spacing between the segments 72*b*, 73*b*. The small plate 71 can be removed by unscrewing a nut 70 (FIG. 1) that holds it fixed to the side 15.

Figure 4:
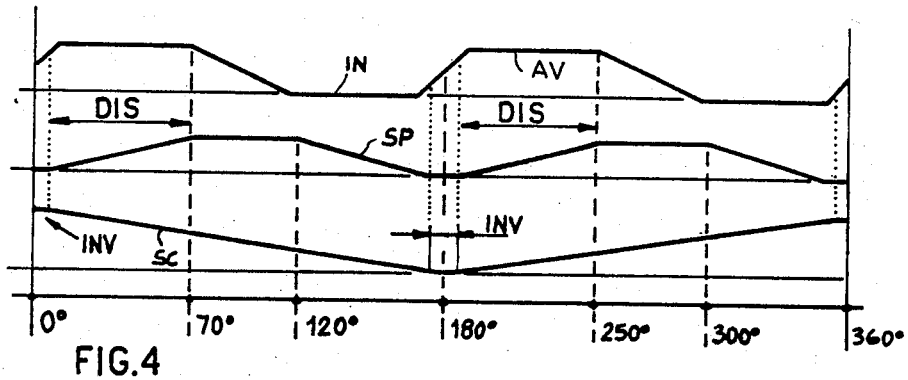
FIG. 4 shows the displacement diagrams of the cams.

In FIG. 4 the diagram SC shows the profile of the groove 42, which is intended to move the head 26, as a function of the angle of rotation of the cylinder 44, while the diagrams IN and SP relate to the profiles of cams 48 and 46 respectively provided for line spacing and axial displacement of the beam 50. It is clear from these diagrams that corresponding to the phase INV (diagram SC) of reversal of the movement of the slide 20, the cam 46 has zero lift (diagram SP), and the cam 48 has an increasing lift (diagram IN), through which the beam 50, pushed by the spring 45, is engaged with the wheel 62 while the lobe 49 of the cam 48 rotates the beam 50 to advance the writing medium 16 by one line space.

The separation of the beam 50 from the wheel 62 occurs in a portion DIS of the diagrams IN and SP in which the lift of the cam 48 is constant, while the clockwise rotation reloading the beam 50 occurs in the succeeding portion AV in which the lift of the cam 46 is a maximum, that is, the toothing 58 of the beam 50 is completely separated from the wheel 62.

In such circumstances the angular position reached by the platen 10 after each line spacing is no longer affected by successive movements of the beam, thus ensuring constant spacing between the lines of printed dots.

Furthermore in the portion AV, since the platen 10 is completely disengaged from the line spacing device, can be rotated manually to advance the paper tape 16.

We claim:

1. A dot matrix printer comprising a housing, a shaft rotatably mounted on said housing, a cylindrical platen mounted on said shaft, a printing head reciprocally movable along said platen for selectively printing dots on a printing medium located on said platen and a line-spacing device to intermittently advance said medium between two successive lines of printed dots, said line-spacing device comprising a toothed gear wheel mounted on said shaft and coupled with said platen and an arm pivotally mounted on said shaft and arranged for radial and axial displacements on said shaft relative to said toothed gear wheel, said arm being actuated by a single cylically rotatable cam member for intermittently rotating said toothed gear wheel, said cam member having a radial cam profile and an axial cam profile, said arm comprising an axially extending toothed sector engageable with a corresponding frontal toothing of said toothed gear wheel, a first cam follower actuated by said axial cam profile for axially translating said arm with respect to said toothed gear wheel from a first position in which said sector meshes with said frontal toothing to a second position in which said sector is axially spaced from the toothed wheel, and a second cam follower actuated by said radial cam profile for rotating said arm in a direction to advance said medium when said arm is in said first position and for rotating said arm in an opposite direction when in said second position.

2. A printer according to claim 1, wherein said cam member also bears a helical cam profile engaging a peg of said head to reciprocate the head along said platen, said head being energized by a succession of electric pulses synchronized with the movement of said head, to print dots spaced by a predetermined step, the printer further comprising an insulating plate removably screwed on said housing and having a pair of circular conductive tracks concentric with said cam member, each track having radial segments angularly spaced by a predetermined amount corresponding to saidpredetermined step, said cam member having a rotatable electric contact element sliding on said segments for generating timing signals of predetermined rate for said pulses, whereby said steps between the dots may be changed by replacing said insulating plate.

3. A printer according to claim 2, wherein said plurality of tracks comprises a first annular track which is coaxial with the cam member, a second and a third track each having radial segments which are equidistant and electrically connected together, the segments of the second track being regularly interposed between the segments of the third track so that the contact element connects the annular track alternately with the second and third tracks.

4. A printer according to claim 1, wherein each of said cam profiles includes a pair of diametrically opposed lobes for rotating and translating said arm in two successive cycles during one complete rotation of the cam member.

* * * * *